US011081787B2

(12) United States Patent
Luna et al.

(10) Patent No.: US 11,081,787 B2
(45) Date of Patent: Aug. 3, 2021

(54) ANTENNA ARRAY RADIATION SHIELDING

(71) Applicant: Viasat, Inc., Carlsbad, CA (US)

(72) Inventors: Joseph Luna, Carlsbad, CA (US); Luis Astorga, Carlsbad, CA (US); Thomas Stutting, Carlsbad, CA (US)

(73) Assignee: Viasat, Inc., Carlsbad, CA (US)

( * ) Notice: Subject to any disclaimer, the term of this patent is extended or adjusted under 35 U.S.C. 154(b) by 0 days.

(21) Appl. No.: 16/621,462

(22) PCT Filed: Jun. 19, 2018

(86) PCT No.: PCT/US2018/038328

§ 371 (c)(1),
(2) Date: Dec. 11, 2019

(87) PCT Pub. No.: WO2018/236902

PCT Pub. Date: Dec. 27, 2018

(65) Prior Publication Data

US 2020/0176863 A1 Jun. 4, 2020

Related U.S. Application Data

(60) Provisional application No. 62/522,580, filed on Jun. 20, 2017.

(51) Int. Cl.
*H01Q 1/36* (2006.01)
*H01Q 1/52* (2006.01)
(Continued)

(52) U.S. Cl.
CPC ..... *H01Q 1/526* (2013.01); *H01Q 1/2283* (2013.01); *H01Q 1/48* (2013.01); *H01Q 21/065* (2013.01)

(58) Field of Classification Search
CPC ..... H01Q 1/526; H01Q 1/2283; H01Q 1/48; H01Q 21/065; H01Q 1/288; H01Q 1/002
(Continued)

(56) References Cited

U.S. PATENT DOCUMENTS 5,406,117 A 4/1995 Dlubokecki et al.
5,608,414 A 4/1997 Amore
(Continued)

FOREIGN PATENT DOCUMENTS

EP 2290684 A1 3/2011
WO WO2012/103821 A2 8/2012

OTHER PUBLICATIONS

Barth, "Radiation Assurance for the space environment", IEEE, May 18-20, 2004.

*Primary Examiner* — Jean B Jeanglaude
(74) *Attorney, Agent, or Firm* — Holland & Hart LLP

(57) ABSTRACT

An antenna array may include shielding elements that provide a degree of radiation shielding to other components of the antenna array, such as a substrate of the antenna array. In some examples, the shielding elements may be positioned to overlap with one or more gaps between antenna elements, or one or more gaps between ground elements (e.g., when viewed from a radiation source, when viewed in a direction perpendicular to a substrate). Thus, shielding elements of an antenna array may reflect, absorb, or otherwise dissipate radiation that passes through such gaps before the radiation is incident on the other components of the antenna array, such as the substrate of the antenna array.

26 Claims, 5 Drawing Sheets

(51) Int. Cl.
*H01Q 1/22* (2006.01)
*H01Q 1/48* (2006.01)
*H01Q 21/06* (2006.01)

(58) Field of Classification Search
USPC ..... 343/700
See application file for complete search history.

(56) References Cited

U.S. PATENT DOCUMENTS

| | | | | |
|---|---|---|---|---|
| 5,872,542 | A * | 2/1999 | Simons | H01Q 1/1271 343/700 MS |
| 6,452,263 | B1 | 9/2002 | Benedetto | |
| 6,458,893 | B1 | 10/2002 | Tasaka et al. | |
| 6,650,003 | B1 | 11/2003 | Benedetto | |
| 7,144,804 | B2 | 12/2006 | Strobel et al. | |
| 7,154,356 | B2 * | 12/2006 | Brunette | H05K 1/0222 333/33 |
| 7,382,043 | B2 | 6/2008 | Longden et al. | |
| 7,923,822 | B2 | 4/2011 | Karnezos | |
| 8,018,739 | B2 | 9/2011 | Patterson | |
| 8,779,562 | B2 | 7/2014 | Lee et al. | |
| 8,866,693 | B2 * | 10/2014 | Nogami | H01Q 9/0414 343/848 |
| 9,048,542 | B2 * | 6/2015 | Han | H01Q 9/0407 |
| 9,153,542 | B2 * | 10/2015 | Lin | H01L 23/66 |
| 9,236,354 | B2 | 1/2016 | Maillard et al. | |
| 2006/0256016 | A1 * | 11/2006 | Wu | H01Q 21/065 343/700 MS |
| 2007/0285316 | A1 | 12/2007 | Saily | |
| 2017/0149120 | A1 | 5/2017 | Zimmerman | |
| 2018/0205155 | A1 * | 7/2018 | Mizunuma | H01Q 21/0025 |
| 2019/0191597 | A1 * | 6/2019 | Han | H01Q 1/526 |

* cited by examiner

ANTENNA ARRAY RADIATION SHIELDING

CROSS REFERENCE TO RELATED APPLICATION

The present application is a 371 national phase filing of International Application No. PCT/US2018/038328 by LUNA, et al., entitled "Antenna Array Radiation Shielding" filed Jun. 19, 2018, assigned to the assignee hereof, and expressly incorporated by reference herein in its entirety.

BACKGROUND

The present disclosure relates generally to antennas, and more specifically to systems and methods for antenna array radiation shielding.

A component may be exposed to various forms of radiation, such as wave radiation, electromagnetic radiation, particle radiation, or other types of ionizing radiation while in space. In some examples, the component may be contained in an enclosure that provides shielding from incident radiation. However, some components, such as an array of antenna elements (e.g., a patch antenna), may not support being shielded in such a manner because doing so would also prevent normal antenna operation (transmission and/or reception of electromagnetic signals). Thus, certain antennas may include an antenna array that is exposed to incident radiation.

In some examples, antenna elements or ground elements of such an antenna array may provide a degree of radiation shielding to other components of the antenna, such as a substrate on which the antenna elements or ground elements are coupled. However, shielding provided by such components of an antenna array may be incomplete or otherwise insufficient for shielding the other components of the antenna, as a result of gaps or other discontinuities between such components of the antenna array.

SUMMARY

In accordance with aspects of the present disclosure, an antenna array may include shielding elements that provide a degree of radiation shielding to other components of the antenna array, such as a substrate of the antenna array.

For example, an antenna array in accordance with aspects of the present disclosure may include a substrate, which in various examples may include a printed circuit board, a semiconductor chip or wafer (e.g., a silicon (Si) chip or wafer, a silicon-germanium (SiGe) chip or wafer), or other suitable substrate construction. In some examples, an antenna array may be considered as including a plurality of antenna units. Each of the antenna units may include an antenna element electrically coupled with a surface of the substrate. Each of the antenna units may also include a ground element electrically coupled with the surface of the substrate and positioned between the corresponding antenna element and the surface of the substrate.

Such an antenna array may also include a plurality of shielding elements disposed between the surface of the substrate and the ground elements of the plurality of antenna units. In some examples, each of the plurality of shielding elements may be coupled with no more than one of the plurality of antenna units. For each of a plurality of gaps between ground elements of adjacent antenna units, a projected area of a respective gap in a direction perpendicular to the surface of the substrate, or perpendicular to the surface of a representative substrate layer, may be incident on at least one of the plurality of shielding elements.

In some examples, an antenna array may be considered as having a sequence of layers, where the layers may refer to particularly constructed portions (e.g., layers of a particular material, layers of a particular manufacturing step), or the layers may refer more generally to a spatial description of related components that may or may not be associated with a particular construction technique. For example, an antenna array in accordance with the present disclosure may include an antenna element layer having a plurality of antenna elements electrically coupled with a substrate. Such an antenna array may also include an antenna ground layer between the antenna element layer (e.g., the plurality of antenna elements) and the substrate. The antenna ground layer may include a plurality of ground elements each corresponding to a respective one of the antenna elements, and each of the ground elements may also be electrically coupled with the substrate.

Such an antenna array may also include a shielding layer between the antenna ground layer and the substrate. The shielding layer may include a plurality of shielding elements between the antenna ground layer and the substrate. The collective area of the shielding elements may provide a degree of radiation shielding for other portions of the antenna array, such as the substrate. For each of a plurality of gaps of the antenna ground layer, a projected area of a respective gap in a direction perpendicular to the surface of the substrate, or perpendicular to the surface of a representative substrate layer, may be incident on at least one of the plurality of shielding elements. In some examples, each of the shielding elements may be coupled with no more than one of the plurality of ground elements.

The foregoing has outlined rather broadly the features of an example according to the disclosure in order that the detailed description that follows may be better understood. Additional features and advantages will be described hereinafter. The conception and specific examples disclosed may be readily utilized as a basis for modifying or designing other methods or apparatuses for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Systems and methods are described for supporting radiation shielding of an antenna array. For example, an antenna array in accordance with the present disclosure may include shielding elements that provide a degree of radiation shielding to other components of the antenna array, such as a substrate of the antenna array. In some examples, the shielding elements may be positioned to overlap with one or more gaps between antenna elements, or one or more gaps between ground elements (e.g., when viewed from a radiation source, when viewed in a direction perpendicular to a substrate, when viewed in directions at a range of angles from a direction perpendicular to a substrate). In other words, shielding elements of an antenna array in accordance with aspects of the present disclosure may reflect, absorb, or otherwise dissipate radiation that passes between antenna elements or ground elements before the radiation is incident on the other components of the antenna array, such as the substrate of the antenna array.

This description provides examples, and is not intended to limit the scope, applicability or configuration of embodiments of the principles described herein. Rather, the following description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

Figure 1:
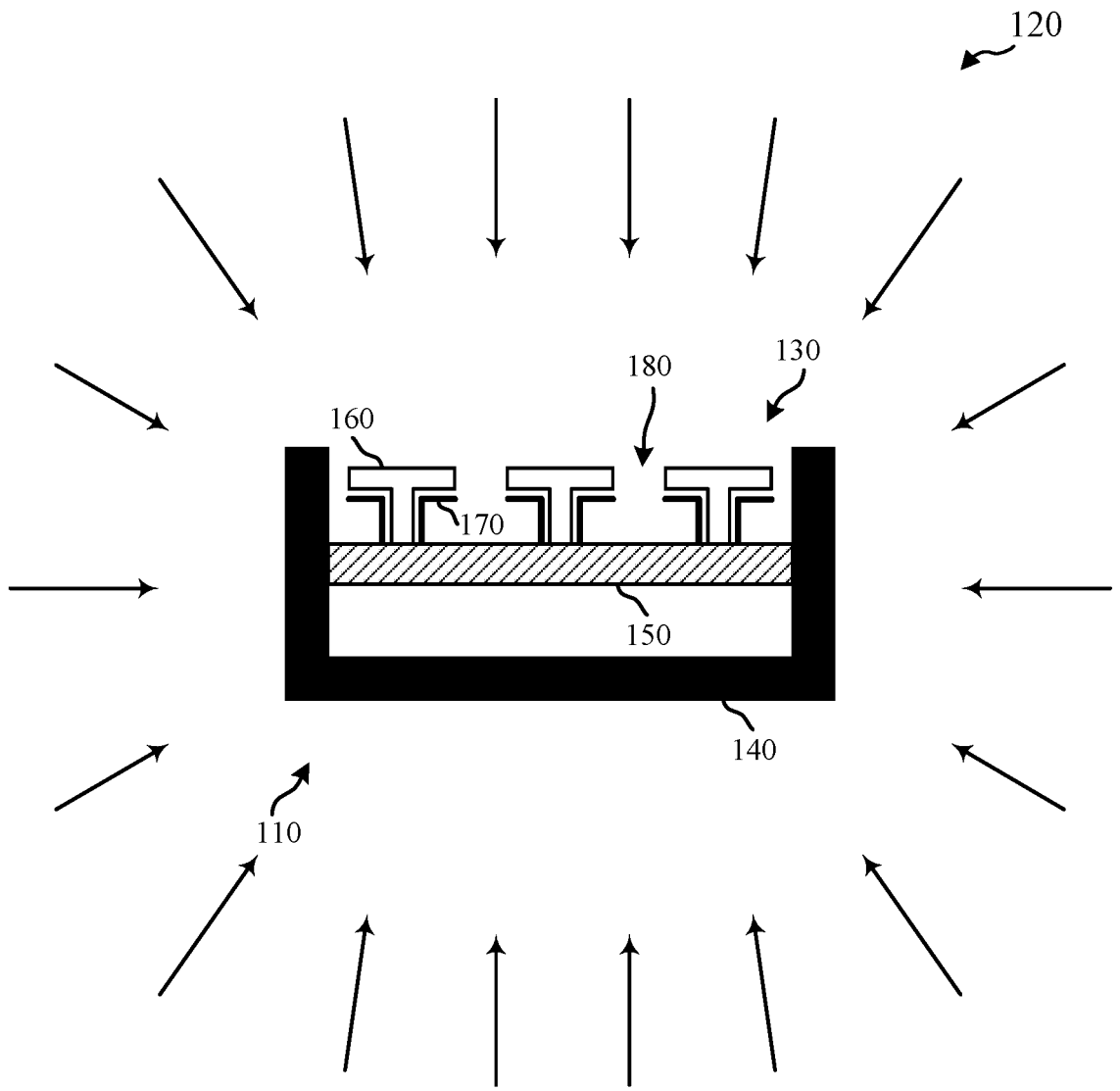
FIG. 1 illustrates an example of an antenna assembly exposed to radiation, in accordance with aspects of the present disclosure.

FIG. 1 illustrates an example of an antenna assembly 110 exposed to radiation 120, in accordance with aspects of the present disclosure. The radiation 120 may refer to radiation emanating from a particular radiation source or may refer to radiation emanating from multiple sources. Further, the radiation 120 may illustrate radiation that may be experienced by the antenna assembly 110 over time, which may include radiation sources that change position with respect to the antenna assembly 110 over time, or the antenna assembly 110 changing orientation with respect to one or more radiation sources over time, or a combination thereof. In some examples, the radiation 120 may refer to radiation experienced by the antenna assembly 110 in a space application (e.g., in an orbital application, in an application outside of Earth's atmosphere). The antenna assembly 110 may include an antenna array 130 positioned in an enclosure 140. The antenna array 130 may include a substrate 150 upon which a number of antenna elements 160 and a number of ground elements 170 are coupled.

In various examples, the substrate 150 may include a printed circuit board (PCB), a semiconductor chip or wafer (e.g., a silicon (Si) chip or wafer, a silicon-germanium (SiGe) chip or wafer), or other suitable substrate construction. In some examples the substrate may also include other integrated circuits (IC) or circuit components (e.g., subcomponents of the substrate), which may support the operation of the antenna array 130. For example, the substrate 150 may include various transistors, diodes, capacitors, inductors, amplifiers, phase shifters, analog or digital signal processing components, or other components. In various examples one or more of such subcomponents of the substrate 150 may be formed integrally as a portion of the substrate 150 (e.g., transistors of a semiconductor chip of the substrate 150) or may be a component separately coupled with (e.g., adhered to, soldered to, mounted to) a portion of the substrate 150 (e.g., an IC chip soldered to a PCB of the substrate 150).

Various portions of the substrate 150 may be susceptible to damage when exposed to radiation 120, such as a radiation environment experienced when operating in space. In some examples, portions of the substrate 150 may be designed to tolerate radiation 120, which may be referred to as radiation hardening by design (RHBD). Although RHBD may enhance the radiation tolerance of the substrate 150, RHBD may not make the substrate 150 impervious to radiation exposure. In other words, despite the use of RHBD, circuit life and operability may still be limited depending on the level of exposure.

In some applications, circuits that will be exposed to radiation 120 may be housed in a metallic (e.g., aluminum or other metal) housing to protect the electronic circuits from damaging radiation exposure. Placing circuits in a housing that entirely encloses the circuits (e.g., box-level integration) can significantly reduce the level of radiation exposure when the application allows for such enclosing. However, not all electronic circuit applications allow placement within a shielded box for operation. In such a case the circuits may be exposed to radiation 120, which may result in a limited operational life of the circuits or a lack of functionality of the circuits exposed to radiation 120.

For example, the operation of the antenna array 130 may require that the antenna elements 160 be exposed (e.g., not blocked by the enclosure 140) to support the transmission and reception of signals. In other words, the enclosure 140 may have an opening or aperture to permit the communication of signals via the antenna array 130. Thus, the antenna array 130 may not be entirely shielded by the enclosure 140, such that portions of the antenna array 130 may be exposed to radiation 120. In some antenna arrays, such as the antenna array 130 illustrated in FIG. 1, gaps 180 may be present between antenna elements 160, or between ground elements 170, or both. In some examples, such as the example of antenna assembly 110, gaps 180 between adjacent antenna elements 160 and between adjacent ground elements 170 may be coincident (e.g., along a direction perpendicular to the substrate 150). In other words, a gap 180 may exist between adjacent antenna elements 160 and between their corresponding ground elements 170.

As illustrated in FIG. 1, radiation 120 may pass through the gaps 180, and subsequently contact the substrate 150. Such radiation exposure through the gaps 180 may cause damage to the substrate 150 or various subcomponents of the substrate 150. In accordance with aspects of the present disclosure, shielding elements may be added to the antenna array 130 to improve radiation shielding of various components of the antenna array 130, which may improve the robustness of the antenna array 130 to radiation 120.

Figure 2A:
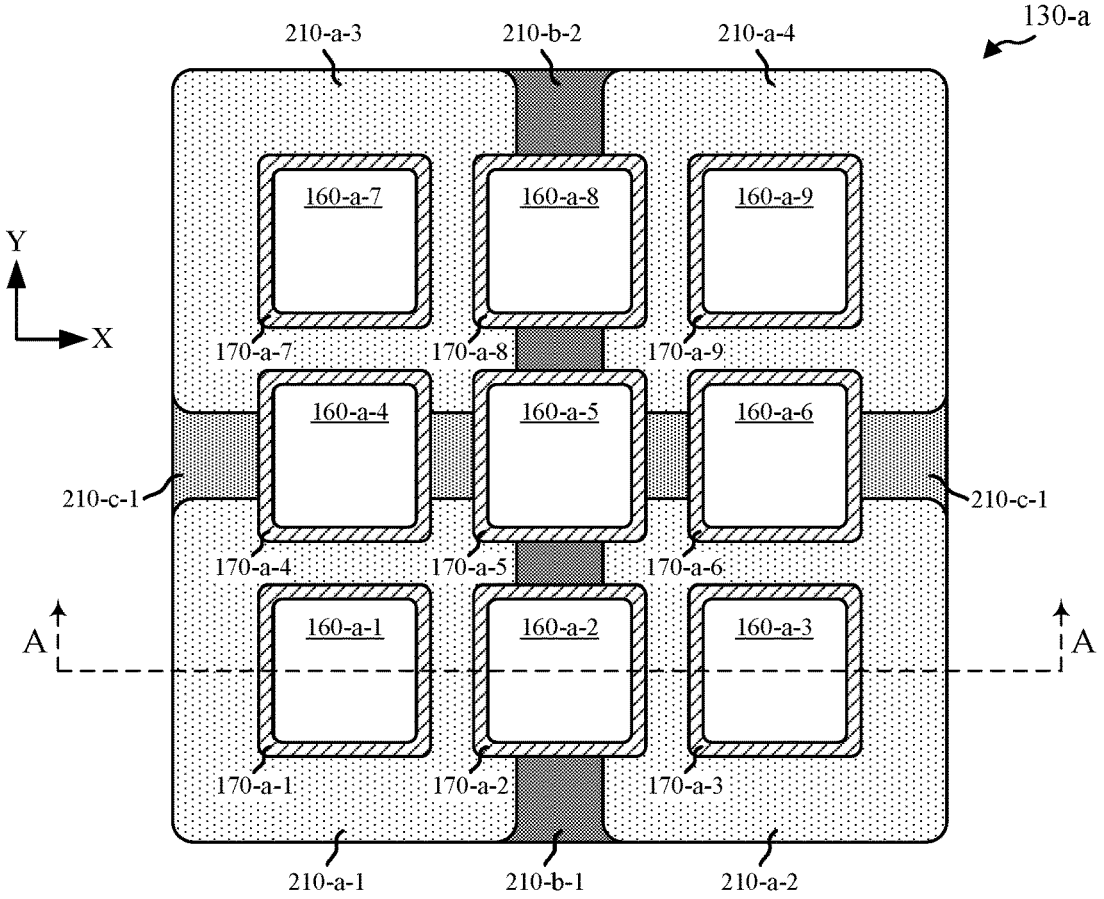
FIGS. 2A through 2D illustrate an example of an antenna array, in accordance with aspects of the present disclosure.
Figure 2B:
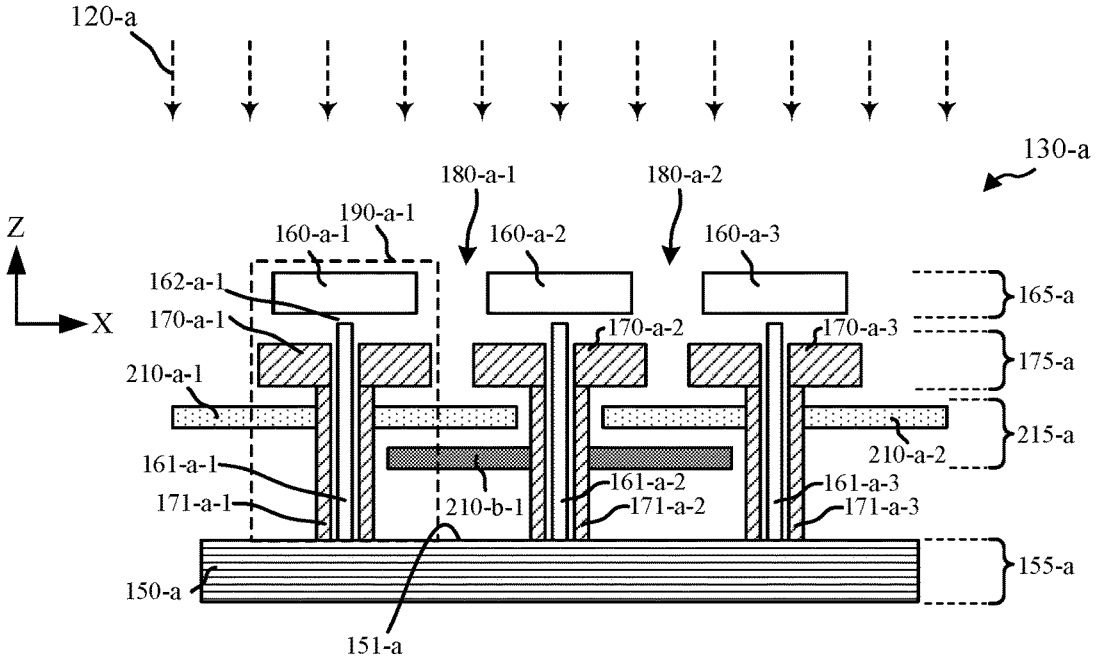
Figure 2C:
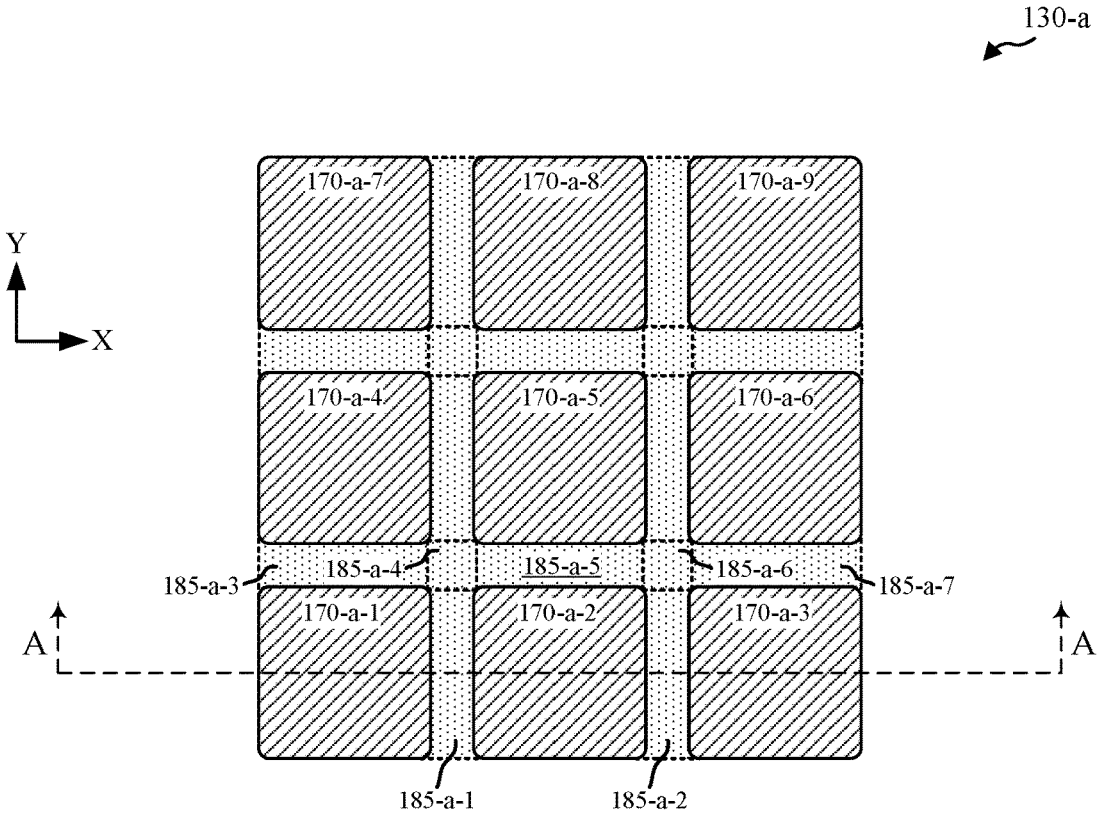

FIGS. 2A through 2D illustrate an example of an antenna array 130-*a* in accordance with aspects of the present disclosure. The antenna array 130-*a* may be an example of an antenna array 130 described with reference to FIG. 1. The antenna array 130-*a* is illustrated in a first view in FIG. 2A, which may be referred to as a "top view" showing an X-Y plane from along the Z direction, and in a second view in FIG. 2B, which may be referred to as a "side view" showing an X-Z plane from along the Y direction (e.g., a section view according to section line A-A as seen in FIG. 2A or 2C). Ground elements 170-*a* of the antenna array 130-*a*, and areas 185-*a* of gaps 180-*a* between the ground elements 170-*a*, are further illustrated in a third view in FIG. 2C, which may also be referred to as a top view showing an X-Y plane from along the Z direction, with other elements of the antenna array 130-*a* omitted for clarity. The projections of the areas 185-*a* along the Z-direction (e.g., between the ground elements 170-*a* and the substrate 150-*a*) are illustrated in a fourth view in FIG. 2D, which may also be referred to as a side view showing an X-Z plane from along the Y direction (e.g., a section view according to section line A-A as seen in FIG. 2A or 2C).

The antenna array 130-*a* may include a substrate 150-*a* upon which a plurality of antenna elements 160-*a* and a plurality of ground elements 170-*a* are coupled. The substrate 150-*a*, the antenna elements 160-*a*, and the ground elements 170-*a* may be examples of the corresponding components described with reference to FIG. 1. In some examples, the antenna array 130-*a* may be disposed in an enclosure, such as enclosure 140 described with reference to FIG. 1, where at least a portion of the antenna array 130-*a* is exposed to radiation 120-*a*.

The substrate 150-*a* may be formed from any material or combination of materials that supports electrical coupling of the substrate 150-*a* with the antenna elements 160-*a* and ground elements 170-*a* (e.g., via the surface 151-*a* of the substrate 150-*a*). In some examples, the substrate 150-*a* may include a printed circuit board, which may be formed at least in part from alternating layers of conductive material and insulating material such as alternating layers of copper and epoxy-impregnated fiberglass. In some examples, the substrate 150-*a* may include a semiconductor chip (e.g., a silicon chip, a silicon-germanium chip). The substrate 150-*a* may include various circuit components that support aspects of the operation of the antenna array 130-*a*, such as active elements, passive elements, or conductive portions between subcomponents of the substrate 150-*a*, which may be integrally formed in the substrate 150-*a*, or otherwise attached as part of the substrate 150-*a* (e.g., surface mounted, embedded). Although illustrated as having a planar surface 151-*a* (e.g., a flat surface when viewed in an X-Z plane), the surface 151-*a* may have other shapes such as cylindrical surface, a spherical surface, a hyperbolic surface, a stepped surface, a sawtooth surface, or any other surface profile.

As described herein, the substrate 150-*a*, or various portions thereof (e.g., at least a portion of the surface 151-*a* of the substrate 150-*a*, components beneath the surface 151-*a* of the substrate 150-*a*), may be sensitive to radiation 120. According to various aspects, the antenna array 130-*a* includes shielding elements 210 that shield portions of the substrate 150-*a* from radiation (e.g., radiation that is not otherwise shielded by an enclosure 140, or other portions of the antenna array 130-*a* that provide a shielding functionality).

The antenna elements 160-*a* may be formed from a conductive material, such as copper, silver, gold, or other conductive material or alloy. Adjacent antenna elements 160-*a* may be separated from adjacent antenna elements 160-*a* by gaps between conductive materials of the antenna elements 160-*a*, which may include voids, insulating material portions, dielectric material portions, or combinations thereof. In some examples, an antenna array 130 may lack a conductive path between the adjacent antenna elements 160. For example, in the antenna array 130-*a*, adjacent antenna elements 160-*a* are not connected by a conductive path between adjacent antenna elements 160-*a* (e.g., within an antenna layer 165). In some examples, adjacent antenna elements 160-*a* may be physically separated from each other (e.g., not physically coupled to each other within an antenna layer 165-*a*).

In the example of antenna array 130-*a*, each of the antenna elements 160-*a* may have a generally square shape (e.g., in an X-Y plane), and may have rounded corners as illustrated. Other examples of antenna elements 160 may have sharp (e.g., non-rounded) corners (e.g., in an X-Y plane). Although the example of antenna array 130-*a* is illustrated as having antenna elements 160-*a* with a generally square shape, other antenna arrays 130 in accordance with the present disclosure may include antenna elements 160 having other shapes (e.g., in an X-Y plane), such as circular antenna elements 160, elliptical antenna elements 160, rectangular antenna elements 160, triangular antenna elements 160, trapezoidal antenna elements 160, hexagonal antenna elements 160, and others. In some examples, an antenna element 160 may have a top surface that is non-planar (e.g., having a surface opposite from the substrate that is not flat when viewed in an X-Z plane or an X-Y plane).

In the example of antenna array 130-*a*, the antenna elements 160-*a* are arranged in a square pattern (e.g., as arranged in an X-Y plane), where adjacent antenna elements 160-*a* are distributed by a same distance in the X-direction and the Y-direction. For example, antenna elements 160-*a*-1, 160-*a*-2, and 160-*a*-3 may be considered as part of a row of antenna elements 160-*a*, and antenna elements 160-*a*-1, 160-*a*-4, and 160-*a*-7 may be considered as part of a column of antenna elements 160-*a*. Although the example of antenna array 130-*a* is illustrated as having antenna elements 160-*a* arranged in a square pattern, other antenna arrays 130 in accordance with the present disclosure may include antenna elements 160 arranged in other patterns, such as rectangular patterns, triangular patterns, trapezoidal patterns, hexagonal patterns, and others.

In the example of antenna array 130-*a*, the antenna elements 160-*a* may be described as forming a planar array. In the planar array of antenna array 130-*a*, a top surface of each of the antenna elements 160 may be coplanar (e.g., having a same position in the Z-direction). However, other antenna arrays 130 in accordance with the present disclosure may include antenna elements 160 having different positions in the Z-direction (e.g., different heights, different elevations, layered heights, staggered heights), which in some examples may also be referred to as a planar array. Further, although the example of antenna array 130-*a* is illustrated as a planar array, other antenna arrays 130 in accordance with the present disclosure may include curved arrays, where positions of adjacent antenna elements 160 may follow a circular, elliptical, hyperbolic, or other change in orientation or position in the Z-direction along the X-direction, or along the Y-direction, along a direction between the X-direction and the Y-direction, or a combination thereof.

The set of antenna elements 160-*a*-1 through 160-*a*-9 may be described as being components of an antenna element layer 165-*a*, which may generally refer to a region in the Z-direction where antenna elements 160-*a* are disposed relative to other described components or layers. As used herein, the term "antenna element layer" may refer to a relative region of antenna elements 160-*a* in the Z-direction for illustrative purposes. More generally, in the example of antenna array 130-*a*, the set of antenna elements 160-*a* may be located farther from the substrate in the Z-direction than the other illustrated components of the antenna array 130-*a*. However, it should be understood that other components that are not illustrated in the antenna array 130-*a* may be included in other antenna arrays 130 in accordance with the present disclosure, and may be located nearer to, or farther from the substrate 150-*a* than the antenna elements 160-*a* or the antenna element layer 165-*a*. In some examples, the antenna element layer 165-*a* may include antenna elements 160-*a* that are formed from a sheet of material (e.g., a sheet of copper), where regions of the sheet of material are removed (e.g., etched, stamped, laser cut) such that the remaining portions of the sheet of material form at least the set of antenna elements 160-*a*. Although described in the context of a sheet of material for illustrative purposes, antenna elements 160-*a* may be formed by other processes, such as 3-dimensional printing or other additive manufacturing, or various combinations of additive and subtractive manufacturing.

Each of the antenna elements 160-*a* may be electrically coupled with the substrate 150-*a* (e.g., electrically coupled with the surface 151-*a* of the substrate 150-*a*). In the example of antenna array 130-*a*, each of the antenna elements 160-*a* may be associated with a respective antenna feed 161-*a* (e.g., an antenna element feed), which may be an example of a conductive antenna feed 161. For example, antenna element 160-*a*-1 may be associated with an antenna feed 161-*a*-1, antenna element 160-*a*-2 may be associated with an antenna feed 161-*a*-2, antenna element 160-*a*-3 may be associated with an antenna feed 161-*a*-3, and so on. The antenna feeds 161-*a* may be formed from a conductive material, such as copper, silver, gold, or other conductive material or alloy, and may be formed of a same material as a corresponding antenna element 160-*a*, or a different material.

In the example of antenna array 130-*a*, each of the conductive antenna feeds 161-*a* may pass through other components disposed between a respective antenna element 160-*a* and the substrate 150-*a*, such as passing through a ground element 170-*a* (e.g., a ground element 170-*a* associated with the respective antenna element 160-*a*). Although antenna feeds 161-*a* are illustrated as being parallel to the Z-direction, other examples of antenna feeds 161 in accordance with the present disclosure may be oriented in a skewed direction (e.g., not parallel to the Z-direction). Further, some examples of antenna feeds 161 in accordance with the present disclosure may follow a nonlinear path between a corresponding antenna element 160 and a substrate 150, such as a curved path, a stepped path, and others, and may have a non-uniform cross-section along the Z-direction (e.g., in an X-Y plane) or other direction. In some antenna arrays 130, one or more antenna elements 160 may be associated with multiple antenna feeds 161 (e.g., multiple antenna feeds 161 between a particular antenna element 160 and a substrate 150).

In some examples, a respective one of the antenna elements 160 may be conductively coupled with its corresponding antenna feed 161. For example, an antenna element 160 and a corresponding antenna feed 161 may be formed from a continuous conductive material or formed from separate materials having an interface that otherwise supports the conduction of electrons (e.g., a soldered interface, a brazed interface, a welded interface). In some examples, including those where an antenna element 160 and a corresponding antenna feed 161 are made from a same material (e.g., a monolithic antenna element and feed), the use of the term "layer" in an antenna element layer 165 may refer to an illustrative construct that refers to those portions of the antenna element 160 or antenna feed 161 that fall within the illustrative antenna element layer 165 (e.g., an active portion of respective antenna elements 160) in the Z-direction.

In the example of antenna array 130-*a*, respective ones of the antenna elements 160-*a* are separated from their corresponding antenna feed 161-*a* by separations 162-*a* (e.g., separations 162-*a*-1 between antenna element 160-*a*-1 and its corresponding antenna feed 161-*a*-1). Separations 162 may refer to a non-conductive void or material discontinuity between an antenna element 160 and an associated antenna feed. In some examples, separations 162-*a* may support a capacitive coupling between antenna elements 160-*a* and their corresponding antenna feeds 161-*a*. Such a capacitive coupling may permit the passage of relatively high frequency signals across the separations 162-*a*, while mitigating effects of DC or other offset (e.g., mitigating the effect of static or low-frequency voltage differences between various ones of the antenna elements 160-*a*, acting as a passive high-pass filter). Although the separations 162-*a* are illustrated as material gaps (e.g., voids, material discontinuities), in some examples separations 162 may be filled with a substantially non-conductive material such as a dielectric or other electrical insulator (e.g., in contrast with electrically conductive materials of antenna elements 160 and antenna feeds 161). In some examples, a combination an antenna element 160 and antenna feed 161 that are capacitively coupled via a separation 162 may be referred to as, or otherwise include, a combination of an antenna element 160, an antenna feed 161, and a capacitor electrically coupled in series between the antenna element 160 and the antenna feed 161.

In the example of antenna array 130-*a*, antenna feeds 161-*a* are illustrated as having a substantially smaller area in an X-Y plane at the separations 162-*a* than the area of the corresponding antenna elements 160-*a* opposite the separations 162-*a*. In other examples of antenna arrays 130 in accordance with the present disclosure, the areas of the antenna feeds 161 and the antenna elements 160 on opposite sides of separations 162 may be selected to support particular capacitance, or other performance factors. For example, in some examples an area in an X-Y plane of an antenna element 160 at one side of a separations 162 may be substantially equal to an area in an X-Y plane of a corresponding antenna feed 161, which may maximize capacitive coupling between the antenna element 160 and the corresponding antenna feed 161 for a given antenna element size. Further, the distance between antenna elements 160 and corresponding antenna feeds 161 (e.g., the size of the separations 162 in the Z-direction) may also be selected to support particular capacitance, or other performance factors.

In the example of antenna array 130-*a*, each of the antenna elements 160 may be associated with a corresponding ground element 170-*a*. For example, antenna element 160-*a*-1 may be associated with ground element 170-*a*-1, antenna element 160-*a*-2 may be associated with ground element 170-*a*-2, antenna element 160-*a*-3 may be associated with ground element 170-*a*-3, and so on. Each of the ground elements 170-*a* may be electrically coupled with the substrate 150-*a* (e.g., with the surface 151-*a* of the substrate 150-*a*). As shown in the example of antenna array 130-*a*, each of the ground elements 170-*a* may be disposed between a corresponding antenna element 160-*a* and the substrate 150-*a* (e.g., at a position in the Z-direction that is between a position of a corresponding antenna element 160-*a* in the Z-direction and a position of the substrate 150-*a* in the Z-direction). The ground elements 170-*a* may be formed from a conductive material, such as copper, silver, gold, or other conductive material or alloy, which may be a same material as is used in the antenna elements 160-*a*, or may be a different material from a material used in the antenna elements 160-*a*.

The set of ground elements 170-*a*-1 through 170-*a*-9 may be described as being components of an antenna ground layer 175-*a*, which may generally refer to a region in the Z-direction where ground elements 170-*a* are disposed relative to other described components. In other words, as used herein, the term "antenna ground layer" may refer to a relative region of ground elements 170-*a* in the Z-direction for illustrative purposes (e.g., a region along the Z-direction between the antenna element layer 165-*a* and the substrate 150-*a*). More generally, in the example of antenna array 130-*a*, the set of ground elements 170-*a* may be located between (e.g., in the Z-direction) corresponding antenna elements 160-*a* and the substrate 150-*a*. However, it should be understood that other components that are not illustrated in the antenna array 130-*a* may be located between an antenna element 160-*a* and a corresponding ground element 170-*a*, or located between a ground element 170-*a* and the substrate 150-*a*.

In some examples, the antenna ground layer 175-*a* may include ground elements 170-*a* that are formed from a sheet of material (e.g., a sheet of copper), where regions of the sheet of material are removed (e.g., etched, stamped, laser cut) such that the remaining portions of the sheet of material form at least the set of ground elements 170-*a*. In some examples, adjacent ground elements 170 may remain interconnected by ground element couplings (not shown), which may include a material portion (e.g., a remaining portion of the sheet of material) and a gap portion (e.g., a portion of the sheet of material removed by etching, stamping, laser cutting, or other process). Although described in the context of a sheet of material for illustrative purposes, components of an antenna ground layer 175 (e.g., ground elements 170 or ground element couplings) may be formed by other processes, such as 3-dimensional printing or other additive manufacturing, or various combinations of additive and subtractive manufacturing. In some examples, ground element couplings between adjacent ground elements 170 may include a material portion having a thickness that is less than a thickness of the coupled ground elements 170. In some examples, the components of an antenna ground layer 175 (e.g., including the ground elements 170 and any ground element couplings) may collectively be referred to as a ground plane of an antenna array 130.

In the example of antenna array 130-*a*, the area in an X-Y plane of a respective ground element 170-*a* is greater than the area in an X-Y plane of a corresponding antenna element 160-*a*. In other words, antenna array 130-*a* may be an example where, for each of the antenna elements 160-*a*, a projection of the area (e.g., in an X-Y plane) of the respective antenna element 160-*a* along a direction perpendicular to the surface of the substrate (e.g., along the Z-direction) overlaps an area of the ground element 170-*a* corresponding to the respective antenna element 160-*a*. In the example of antenna array 130-*a*, the projected area or the projected periphery (e.g., the outer perimeter, the outer extent, the outer dimension) of each of the antenna elements 160-*a* along the Z-direction on the surface of a corresponding ground element 170-*a* is entirely within the outer perimeter of the corresponding ground element 170-*a*. In other examples of antenna arrays 130 in accordance with the present disclosure, the projected area or the projected periphery of an antenna element 160 along the Z-direction on the surface of a corresponding ground element 170 may be coincident with the outer perimeter of the corresponding ground element 170 or may fall at least partially outside the outer perimeter of the corresponding ground element 170.

The relationship of areas between an antenna element 160 and a corresponding ground element 170 may be selected to support desired characteristics of the antenna array 130-*a*, such as particular transmission or reception performance, electrical characteristics, mechanical characteristics, packaging considerations, and others. In some examples a projection of the area or periphery of a respective antenna element 160 may be described as "substantially overlapping" with an area or periphery of a ground element 170 corresponding to the respective antenna element 160, where the phrase "substantially overlapping" may refer to a degree of overlap between an antenna element 160 and a ground element 170 that supports an ability of an antenna array 130 to transmit or receive signals via the respective antenna element 160.

In the example of antenna array 130-*a*, each of the ground elements 170-*a* may be associated with a respective ground feed 171-*a* (e.g., a ground element feed), which may be an example of a conductive ground feed 171. For example, ground element 170-*a*-1 may be associated with a ground feed 171-*a*-1, ground element 170-*a*-2 may be associated with a ground feed 171-*a*-2, ground element 170-*a*-3 may be associated with a ground feed 171-*a*-3, and so on. In some examples (e.g., where adjacent ground elements 170 are interconnected by conductive ground element couplings, not shown), a first subset of one or more ground elements 170 of an antenna array 130 may be associated with ground feeds 171, and a second subset of one or more ground elements 170 of the antenna array 130 may not be associated with ground feeds 171. The ground feeds 171-*a* may be formed from a conductive material, such as copper, silver, gold, or other conductive material or alloy, and may be formed of a same material as a corresponding ground element 170-*a*, or a different material.

Although ground feeds 171-*a* are illustrated as being parallel to the Z-direction, other examples of antenna feeds 171 in accordance with the present disclosure may be aligned in a skewed direction (e.g., not parallel to the Z-direction). Further, some examples of ground feeds 171 in accordance with the present disclosure may follow a non-linear path between a corresponding ground element 170 and a substrate 150, such as a curved path, a stepped path, and others, and may have a non-uniform cross-section along the Z-direction (e.g., in an X-Y plane) or other direction. In some antenna arrays 130, one or more ground elements 170 may be associated with multiple ground feeds 171 (e.g., multiple ground feeds 171 between a particular antenna element 160 and a substrate 150).

In some examples, such as the example of antenna array 130-*a*, a respective one of the ground elements 170 may be conductively coupled with its corresponding ground feed 171. For example, a ground element 170 and a corresponding ground feed 171 may be formed from a continuously conductive material or formed from separate materials having an interface that supports the conduction of electrons (e.g., a soldered interface, a brazed interface, a welded interface). In some examples, including those where a ground element 170 and a corresponding ground feed 171 are made from a same material (e.g., a monolithic ground element and feed), an antenna ground layer 175 may refer to an illustrative construct that refers to those portions of the ground element 170 or ground feed 171 that fall within the illustrative antenna ground layer 175 (e.g., an portion of respective ground elements 170 that interact with antenna elements 160, a portion of respective ground elements 170 between antenna elements 160 and shielding elements 210, a layer between an antenna element layer 165 and a shielding layer 215).

Various elements of the antenna array 130-*a* may be referred to in the context of antenna units 190 that are configured to support transmission of signals via the antenna array 130-*a*, reception of signals via the antenna array 130-*a*, or both. For example, an antenna unit 190 may include at least an antenna element 160 and a corresponding ground element 170, which collectively may be referred to as a radiating element or radiating element pair. For example, as illustrated, a first antenna unit 190-*a*-1 may include the antenna element 160-*a*-1 and the ground element 170-*a*-1. Although only the illustrative boundary for the first antenna unit 190-*a*-1 is shown, a second antenna unit may include the antenna element 160-*a*-2 and the ground element 170-*a*-2. In some examples, an antenna unit may further be described as including a respective antenna feed 161, a respective ground feed 171, or both. For example, the first antenna unit 190-*a*-1 may be considered include the antenna element 160-*a*-1, the antenna feed 161-*a*-1, the ground element 170-*a*-1, and the ground feed 171-*a*-1.

Although the antenna array 130-*a* may support transmission and reception functionality with the plurality of antenna elements 160-*a* being disposed above a continuous ground plane (e.g., a continuous sheet of material in the antenna ground layer 175), a continuous ground plane may have drawbacks in some applications. For example, a continuous ground plane may be susceptible to surface waves, which may refer to a mechanical or electromagnetic phenomenon at the surface of such a continuous ground plane that impairs functioning of the antenna array 130. Further, in examples where an antenna array 130 is made from materials having different coefficients of thermal expansion (CTE), a continuous ground plane may be associated with adverse thermal stresses (e.g., stresses induced by thermal expansion or thermal contraction) in one or more components of the antenna array 130. For example, in an example of an antenna array 130 where the substrate 150 is made from a semiconductor chip (e.g., a silicon chip, a silicon-germanium chip) and a continuous ground plane is made from a different conductive material (e.g., copper), changes in operating temperature of the antenna array 130 may result in normal stress (e.g., compressive stress, tensile stress) in the substrate 150 or the continuous ground plane (e.g., normal stress in an X-Y plane), bending stress in components between the substrate 150 and the continuous ground plane (e.g., bending stress in components such as ground feeds 171 about axes parallel to an X-Y plane), or shear stress at interfaces at the substrate 150 or the continuous ground plane (e.g., shear stress in an X-Y plane at an interface between the substrate 150 and antenna feeds 161 and/or ground feeds 171).

In some examples, such surface wave conditions or loading conditions may be alleviated by mechanically isolating adjacent ground elements 170 by gaps 180-*a* between the adjacent ground elements, such that adjacent ground elements 170 are not mechanically coupled with each other (e.g., in an antenna ground layer 175). Such gaps 180 may break up surface waves or may provide a stress relief functionality. For example, when formed from a continuous layer of material, a plurality of ground elements 170 may be formed by removing a portion (e.g., through the thickness of the continuous layer of material) of the continuous layer of material around an entire periphery of respective ground elements 170. In examples where material is removed in such a manner through the full thickness of the continuous layer of material, adjacent ground elements 170 may therefore be isolated both mechanically and electrically (e.g., in the antenna ground layer 175), as illustrated in the example of antenna array 130-*a*. In other words, in some examples of an antenna array 130 in accordance with the present disclosure, adjacent antenna units of the antenna array 130-*a* may be described as being isolated from each other except by their mechanical or electrical coupling via the substrate 150-*a*.

In some examples, however, it may be preferable to support electrical continuity within an antenna ground layer 175, rather than relying on electrical connections between ground elements 170 via corresponding ground feeds 171 and a substrate 150. Thus, in some examples, an antenna ground layer 175 may include ground element couplings (not shown) between adjacent ground elements, which may provide electrical continuity between the adjacent ground elements 170. In other words, some examples of an antenna array 130 in accordance with the present disclosure may include a plurality of ground element couplings, where each of the ground element couplings couple (e.g., electrically, mechanically) ground elements 170 of adjacent antenna units.

In various examples such ground element couplings may include a material portion and a gap portion (e.g., a gap, void, or discontinuity in material through the ground plane in the Z-direction) or may include a material portion that has a thickness that is less than the thickness of adjacent ground elements 170. More generally, in some antenna arrays 130, ground elements 170 may be interconnected by couplings (e.g., regions of a ground plane, regions of an antenna ground layer 175) that have a compliance that is greater than the ground elements 170, which may provide both electrical continuity (e.g., conductivity) and a stress relief functionality (e.g., between adjacent ground elements 170). Such a stress relief may mitigate the buildup of stresses, such as those described above, by providing relatively flexible movement between the ground elements 170.

One or more of the antenna elements 160-*a* or the ground elements 170-*a* may provide a degree of radiation shielding to other components of the antenna array 130-*a*, such as the substrate 150-*a*. For example, a material included in one or more of the antenna elements 160-*a* or the ground elements 170-*a* may reflect, absorb, or otherwise dissipate radiation 120-*a* before it is incident on the substrate 150-*a* (e.g., incident on the surface 151-*a* of the substrate 150-*a*). However, some of the radiation 120-*a* may pass through gaps 180-*a* between antenna elements 160-*a* or gaps 180-*a* between ground elements 170-*a*, or both, which may leave certain areas of the surface 151-*a* more vulnerable to radiation. The shapes and locations of such gaps 180 may be based on, for example, the shapes of antenna elements 160, the shapes of ground elements 170, the pattern or other arrangement of the antenna elements 160 or ground elements 170, or the presence of relevant coupling elements, including those shapes, patterns, arrangements, and coupling elements described herein. In accordance with aspects of the present disclosure, shielding elements 210 may be included in the antenna array 130-*a* to further shield the substrate 150-*a*, or other components of the antenna array 130-*a*, from radiation that may pass through such gaps 180.

The shielding elements 210 may be formed from a material that provides a degree of radiation shielding along paths through gaps 180-*a* between adjacent antenna elements 160-*a* or between adjacent ground elements 170-*a*. In some examples, shielding elements 210 may be formed from a same material as antenna elements 160-*a* or ground elements 170-*a* (e.g., a conductive material such as copper, silver, gold, or others). In some examples, a plurality of ground elements 170 (e.g., a ground plane, an antenna ground layer 175) and a plurality of shielding elements 210 (e.g., a shielding layer 215) may be a same material but may not have gaps that overlap when viewed in an X-Y plane. In some examples, such a construction may be referred to as a multi-layer ground plane which provides both an antenna ground plane functionality and a distributed shielding functionality, and one or more of the layers of the multi-layer ground plane may include gaps or gap portions (e.g., through a respective layer) that further provide a stress relief functionality. The layers of such a multi-layer ground plane may be separated (e.g., in the Z-direction) by a void in material, or by a material other than the material used to provide ground plane conductivity of shielding (e.g., an electrical insulator, a dielectric material). In some examples, shielding elements 210 may be formed from a different material than antenna elements 160 or ground elements 170, which may be selected for particular shielding properties. For example, one or more shielding elements 210 of an antenna array 130 may be formed from lead, tungsten, aluminum, or other material.

In some examples, like the materials described for antenna elements 160 or ground elements 170, a material selected for shielding elements 210 may have a different coefficient of thermal expansion than a substrate 150. Under such conditions, physically coupling shielding elements 210 directly to the substrate 150 may lead to adverse stress conditions, for example, such as those described above with reference to ground plane and substrate materials. Therefore, in the example of antenna array 130-*a*, the shielding elements 210 may not be directly coupled with the surface 151-*a* of the substrate 150-*a*, and instead may be coupled with a ground feed 171-*a* of a particular antenna unit 190. To maintain the isolation or stress relief between adjacent ground elements 170-*a* in some antenna arrays 130 (e.g., antenna array 130-*a*) each of the shielding elements 210 may be directly coupled with no more than one of the antenna units 190 (e.g., no more than one ground feed 171-*a* or ground feeds 171-*a* of no more than one of the antenna units 190). In other words, a shielding element 210 may be directly coupled with at most one antenna unit 190, which may refer to a shielding element 210 being directly coupled with one antenna unit 190, or no antenna units 190. In examples where a shielding element 210 is directly coupled to one antenna unit, the shielding element may be referred to as being coupled with one and only one antenna unit 190, directly coupled with a single antenna unit 190, directly coupled with only one antenna unit, and so on. In some examples (e.g. antenna array 130-*a*), a respective shielding element 210 may be coupled (e.g., directly coupled) with a single one of the antenna units 190 at a location between the ground element 170 of the antenna unit 190 and the surface of the substrate 150. Additionally or alternatively, the shielding element 210 may be coupled with the ground element 170 of a respective antenna unit 190.

A direct coupling may refer to a mechanical coupling without intervening components or regions. For example, a shielding element 210 being directly coupled with a ground feed 171 may refer to a direct connection between the material of the shielding element 210 and a material of the ground feed 171, which may refer to an illustrative construct of a monolithically-formed shielding element 210 and a ground feed 171 without material voids, or an interface between a shielding element 210 and a ground feed 171 being at a full thickness (e.g., in the Z-direction) of a shielding element 210. In another example, a shielding element 210 being directly coupled with an antenna unit 190 may refer to a mechanical coupling that does not pass through a coupling element, such as a coupling element having a compliance that is greater than a compliance of a shielding element 210. In other words, a direct coupling between a shielding element 210 and an antenna unit 190 may reflect a continuous interface between materials without voids or otherwise more-compliant regions.

In some examples a shielding element 210 may be directly or indirectly coupled with multiple antenna units. In some examples, a shielding element 210 may be coupled with at least one of the plurality of antenna units via an indirect coupling, such as a mechanical or electrical coupling via a stress relief feature such as those described herein with reference to adjacent ground elements 170. For example, an indirect coupling may provide electrical continuity (e.g., conductivity) or a relatively light structural support (e.g., as compared with a relatively strong structural support that may be provided by a direct coupling). In various examples, shielding elements 210 that are indirectly coupled with antenna units 190 may or may not be directly coupled with another antenna unit. In various examples, an antenna array 130 may include a plurality of shielding elements 210 that are directly coupled no more than one antenna unit 190, and each of the respective shielding elements 210 may be indirectly coupled with one or more antenna units 190, or not coupled with any other antenna units 190, whether directly or indirectly.

The example of antenna array 130-*a* may include a first set of shielding elements 210-*a* associated with alternating ground elements 170-*a* (e.g., alternating antenna units) of a described row or column. For example, a shielding element 210-*a*-1 may be associated with the ground element 170-*a*-1, and a shielding element 210-*a*-2 may be associated with the ground element 170-*a*-3. Each of the shielding elements 210-*a* may provide radiation shielding for gaps 180-*a* between the respective associated ground element 170-*a* and the adjacent ground elements 170-*a* (e.g., the ground elements 170-*a* of adjacent antenna units). For example, the shielding element 210-*a*-1 may provide radiation shielding for the gaps 180-*a* between the ground element 170-*a*-1 and ground elements 170-*a*-2 (e.g., gap 180-*a*-1), 170-*a*-4, and 170-*a*-5. In another example, the shielding element 210-*a*-2 may provide radiation shielding for the gaps 180-*a* between the ground element 170-*a*-3 and ground elements 170-*a*-2 (e.g., gap 180-*a*-2), 170-*a*-5, and 170-*a*-6. In other words, the shielding elements 210-*a* may be referred to as extending under the gaps 180-*a*, or extending between the gaps 180-*a* and the substrate 150-*a*. Although described with reference to gaps 180-*a* between ground elements 170-*a*, radiation protection in accordance with the present disclosure may similarly be described or implemented with reference to gaps 180-*a* between antenna elements 160-*a*.

In some examples, an antenna array 130 may include shielding elements 210 at different positions in the Z-direction, which in some examples may support an overlapping of radiation shielding. In other words, an antenna array 130 may include one or more levels of overlapping radiation shielding (e.g., metal), which may be formed overlying the maximum radiation exposure areas (e.g., areas of the antenna array 130 viewed between adjacent antenna elements 160, areas of the antenna array 130 viewed between adjacent ground elements 170) of the substrate 150.

For example, as illustrated, the antenna array 130-*a* may also include a second set of shielding elements 210-*b* associated with different ground elements 170-*a* than the first set of shielding elements 210-*a*. A shielding element 210-*b*-1 may be associated with the ground element 170-*a*-2, and a shielding element 210-*b*-2 may be associated with the ground element 170-*a*-8. Like the first set of shielding elements 210-*a*, each of the shielding elements 210-*b* may provide radiation shielding for gaps between the respective associated ground element 170-*a* and the adjacent ground elements 170-*a*. For example, the shielding element 210-*b*-1 may provide radiation shielding for the gaps between the ground element 170-*a*-2 and ground elements 170-*a*-1 (e.g., gap 180-*a*-1), 170-*a*-4, 170-*a*-5, 170-*a*-6, and 170-*a*-3 (e.g., gap 180-*a*-2). In another example, the shielding element 210-*b*-2 may provide radiation shielding for the gaps 180-*a* between the ground element 170-*a*-8 and ground elements 170-*a*-2, 170-*a*-5, and 170-*a*-6.

Various shielding elements 210 may be arranged in different positions in the Z-direction, which may be considered as sub-layers of the shielding layer 215-*a*. For example, shielding elements 210-*a* may be on a first layer, shielding elements 210-*b* may be on second layer (e.g., that is not coplanar with the first layer), shielding elements 210-*c* may be on a third layer (e.g., that is not coplanar with the first layer or second layer), and shielding elements 210-*d* (not shown, associated with ground element 170-*a*-5, for example) may be on a fourth layer (e.g., that is not coplanar with the first layer, the second layer, or the third layer). In other words, in the example of antenna array 130-*a*, radiation shielding is provided for each of the gaps 180-*a* between antenna elements ground elements 170-*a* by at least two of the shielding elements 210 (e.g., by two or more of a shielding element 210-*a*, a shielding element 210-*b*, a shielding element 210-*c*, or a shielding element 210-*d*, not shown, which may be associated with the ground element 170-*a*-5). Other antenna arrays 130 may include shielding elements 210 that are arranged with a different number of sub-layers of a shielding layer 215, which may depend on how areas of the respective shielding elements 210 overlap (e.g., when viewed along the Z-direction). In some examples, shielding elements 210 arranged in a single layer may have shapes that allow for overlap (e.g., as viewed along the Z-direction), such as an angled shape or a stepped shape.

The plurality of shielding elements 210 may be described as being components of the shielding layer 215-*a*, which may generally refer to a region in the Z-direction where shielding elements 210 are disposed relative to other described components or layers. In other words, as used herein, the term "shielding layer" may refer to a relative region of shielding elements 210 in the Z-direction for illustrative purposes (e.g., between an antenna ground layer 175-*a* and a substrate layer 155-*a*). More generally, in the example of antenna array 130-*a*, the plurality of shielding elements 210 may be located between (e.g., in the Z-direction) ground elements 170-*a* and the substrate 150-*a*. However, it should be understood that other components that are not illustrated in the antenna array 130-*a* may be located between a ground element 170-*a* and a shielding element 210, or located between a shielding element 210 and the substrate 150-*a*.

In some examples, a shielding layer 215 may include shielding elements 210 that are formed from a sheet of material (e.g., a sheet of copper), where regions of the sheet of material are removed (e.g., etched, stamped, laser cut) such that the remaining portions of the sheet of material form at least the plurality of shielding elements 210. In some examples, adjacent shielding elements 210 may remain interconnected by shielding element couplings (not shown), which may include a material portion (e.g., a remaining portion of the sheet of material) and a gap portion (e.g., a portion of the sheet of material removed by etching, stamping, laser cutting, or other process). Although described in the context of a sheet of material for illustrative purposes, components of a shielding layer 215 may be formed by other processes, such as 3-dimensional printing or other additive manufacturing, or various combinations of additive and subtractive manufacturing. In some examples, shielding element couplings between adjacent shielding elements 210 may include a material portion having a thickness that is less than a thickness of the coupled shielding elements 210. In some examples, the components of the shielding layer 215 (e.g., including the shielding elements 210 and any shielding element couplings) may collectively be referred to as a shielding plane of an antenna array 130.

To provide radiation shielding, radiation 120-*a* that passes through gaps 180-*a* between antenna elements 160-*a* or between ground elements 170-*a* may be incident on one or more shielding elements 210. For example, radiation 120-*a* may be illustrative of a distant radiation source that is aligned with the antenna in the Z-direction. Thus, radiation 120-*a* may arrive at the antenna array 130-*a* along the Z-direction, and pass through gaps 180-*a* between the antenna elements 160-*a* and the ground elements 170-*a* in the Z-direction. To provide radiation protection for a particular gap 180-*a* (e.g., between antenna elements 160-*a*, between ground elements 170-*a*) under these circumstances, a projected area of the particular gap 180-*a* in the Z-direction may be incident on at least one of the shielding elements 210 prior to incidence on the substrate 150. In other words, when viewed from the top of the antenna array 130-*a* along the Z-direction (e.g., as in the first view 200), the substrate 150 may not be visible (e.g., through shielding elements 210) between the antenna elements 160-*a* or between the ground elements 170-*a*, because at least one shielding element 210 hides the substrate 150 from view.

Figure 2D:
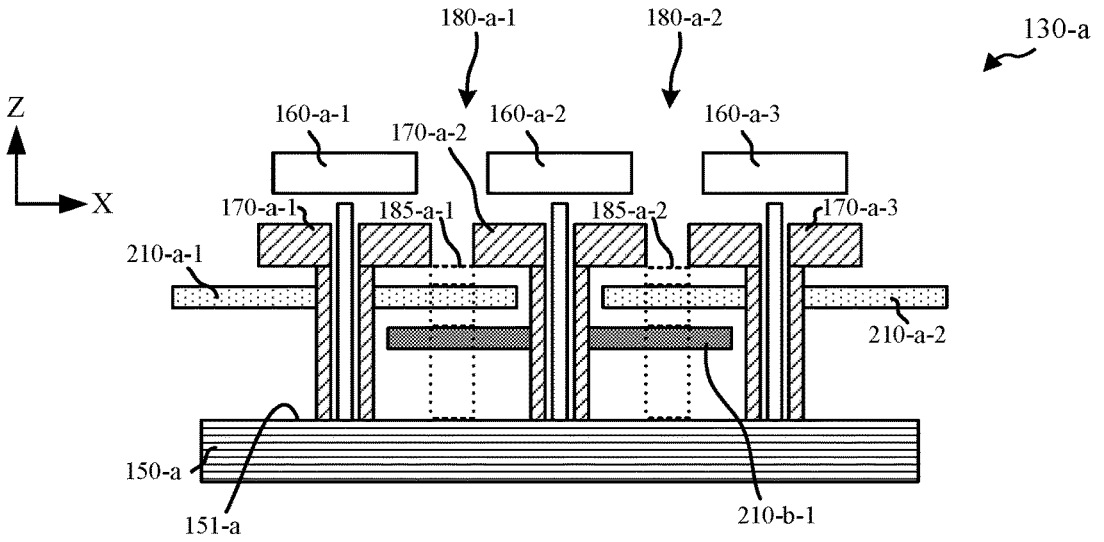

For example, as illustrated in FIGS. 2C and 2D, gaps 180-*a* may be associated with a particular area 185-*a* (e.g., as viewed in an X-Y plane from along a Z-direction in FIG. 2C). As shown, the gap 180-*a*-1 between the ground element 170-*a*-1 and the ground element 170-*a*-2 may be associated with an area 185-*a*-1 between the ground element 170-*a*-1 and the ground element 170-*a*-2, and gap 180-*a*-2 between the ground element 170-*a*-2 and the ground element 170-*a*-3 may be associated with an area 185-*a*-2 between the ground element 170-*a*-2 and the ground element 170-*a*-3, and so on. A projection of the area 185-*a*-1 (e.g., along the Z direction, in a negative Z-direction from the gap 180-*a*-1) may be incident on the shielding element 210-*a*-1 and on the shielding element 210-*b*-1 before being incident on the substrate 150-*a*. In other words, a projection of the area 185-*a*-1 at a position of the shielding element 210-*a*-1 in the Z-direction (e.g., at the top surface of the shielding element 210-*a*-1) may be entirely within the outer perimeter of the shielding element 210-*a*-1, and a projection of the area 185-*a*-1 at a position of the shielding element 210-*b*-1 in the Z-direction (e.g., at the top surface of the shielding element 210-*b*-1) may be entirely within the outer perimeter of the shielding element 210-*b*-1. Similarly, a projection of the area 185-*a*-2 (e.g., along the Z direction, in a negative Z-direction from the gap 180-*a*-2) may be incident on the shielding element 210-*a*-2 and on the shielding element 210-*b*-1 before being incident on the substrate 150-*a*. Although antenna array 130-*a* is described as having projected areas 185-*a* being entirely within a perimeter of a shielding element 210, in other antenna arrays 130, radiation shielding may be provided by having a projected area 185 being partially within a perimeter of one shielding element 210 and partially within a perimeter of another shielding element 210. To provide the described radiation shielding, the relationship between gaps 180 and shielding elements 210 may be defined in various ways. For example, in some examples the areas 185 of gaps 180 may be projected along a direction perpendicular to an illustrative surface of antenna elements 160 (e.g., the top surfaces of the antenna elements 160-*a* in the example of antenna array 130-*a*), or along a direction perpendicular to an illustrative surface of ground elements 170 (e.g., the top surfaces of the ground elements 170-*a* in the example of antenna array 130-*a*). In some examples, the areas 185 of gaps 180 may be projected along a direction that is aligned with a boresight of the antenna array 130. In some examples, the areas 185 of gaps 180 may be projected along a direction perpendicular to a surface of a substrate 150 (e.g., the surface 151-*a* of the substrate 150-*a* in the example of antenna array 130-*a*). In some examples, such as when a surface of a substrate 150 (e.g., a surface 151 upon which antenna elements 160 or ground elements 170 are coupled) is irregular, areas 185 of gaps 180 may be projected along a direction perpendicular to an illustrative boundary of the substrate 150, such as a boundary of an illustrative substrate layer 155 (e.g., a top surface of the substrate layer 155-*a* in the example of antenna array 130-*a*). Other component surfaces, or illustrative layer surfaces, may be used to describe such projections for determining the size and location of shielding elements 210. More generally, the described shielding may be provided such that, when starting from a radiation source, an imaginary line passing through a gap 180 between antenna elements 160 or between ground elements 170 would pass through at least one shielding element 210 before reaching the substrate 150, or other component of the antenna array 130 being shielded.

Although the example of antenna array 130-*a* is shown as being exposed to radiation 120-*a* illustrative of a distant or otherwise distributed radiation source, radiation 120 may have multiple sources that project radiation from different directions with respect to an antenna array 130. Further, an antenna array 130 may be moving with respect to sources of radiation 120. Thus, while a simple projection of areas 185 in the Z-direction or other direction may provide a minimum threshold amount of radiation shielding in some antenna arrays 130, some antenna array 130 may further benefit from radiation protection that is effective against radiation reaching the antenna array from different directions (e.g., in contrast with the example of radiation 120-*a* that is illustrative of a distant radiation source aligned in the Z-direction). To accommodate the different directions of incident radiation, projected areas 185 for defining sizes for shielding elements 210 may be expanded in various ways.

For example, to determine the extents of a shielding element 210 required to provide radiation shielding for a particular gap 180, a projected area 185 may be scaled based on a distance between a gap 180 and the shielding element 210. Generally, when a shielding element 210 is relatively close to a gap 180 (e.g., in the Z-direction), the projected area 185 of a gap 180 may be associated with relatively little scaling. When a shielding element 210 is relatively far from a gap 180 (e.g., in the Z-direction), the projected area 185 of a gap 180 may be associated with relatively more scaling. In some examples, such scaling may be based on the angles of incidence for anticipated radiation, which may consider possible directions of radiation sources, possible directions of radiation 120 that may not be otherwise blocked by an enclosure 140, and other considerations.

In some examples, to determine the extents of a shielding element 210 required to provide radiation shielding for a particular gap 180, a periphery of a projected area 185 may be expanded outward (e.g., outward from the center of the projected area 185, perpendicular to the perimeter of the projected area 185) by a particular distance. For example, when a shielding element 210 is separated by from a gap 180 by a distance d, and radiation 120 may be expected to arrive at an antenna array 130 at angles of +/−θ (e.g., with respect to the Z-direction of antenna array 130-*a*), a periphery of projected areas 185 may be extended outward (e.g., in an X-Y plane in the example of antenna array 130-*a*) by a distance of $\delta = d \tan \theta$. Other methods for determining appropriate size and location of shielding elements 210 may be considered for different types of antenna arrays 130 or positioning of antenna arrays 130 in an enclosure 140. Further, the size and location of shielding elements 210 may be determined based on other considerations such as mechanical properties, areas of a substrate 150 that are more or less sensitive to radiation, and others.

Although the layers of the antenna array 130-*a* (e.g., the antenna element layer 165-*a*, the antenna ground layer 175-*a*, the shielding layer 215-*a*, the substrate layer 155-*b*) are illustrated as being generally planar layers, one or more of the layers of an antenna array 130 in accordance with the present disclosure may have non-planar layers. For example, any one or more of the layers of an antenna array 130 may include a cylindrical surface, a spherical surface, a hyperbolic surface, a prismatic surface, or others. Further, adjacent layers may have a same surface shape (e.g., when such surfaces are coincident) or different surface shapes (e.g., when one layer has an illustrative surface that is irregular, and an adjacent layer has a surface that is smooth). Various layer shapes, or combinations of layer shapes, may be used to illustrate different groups of components that support the radiation shielding described herein.

Figure 3A:
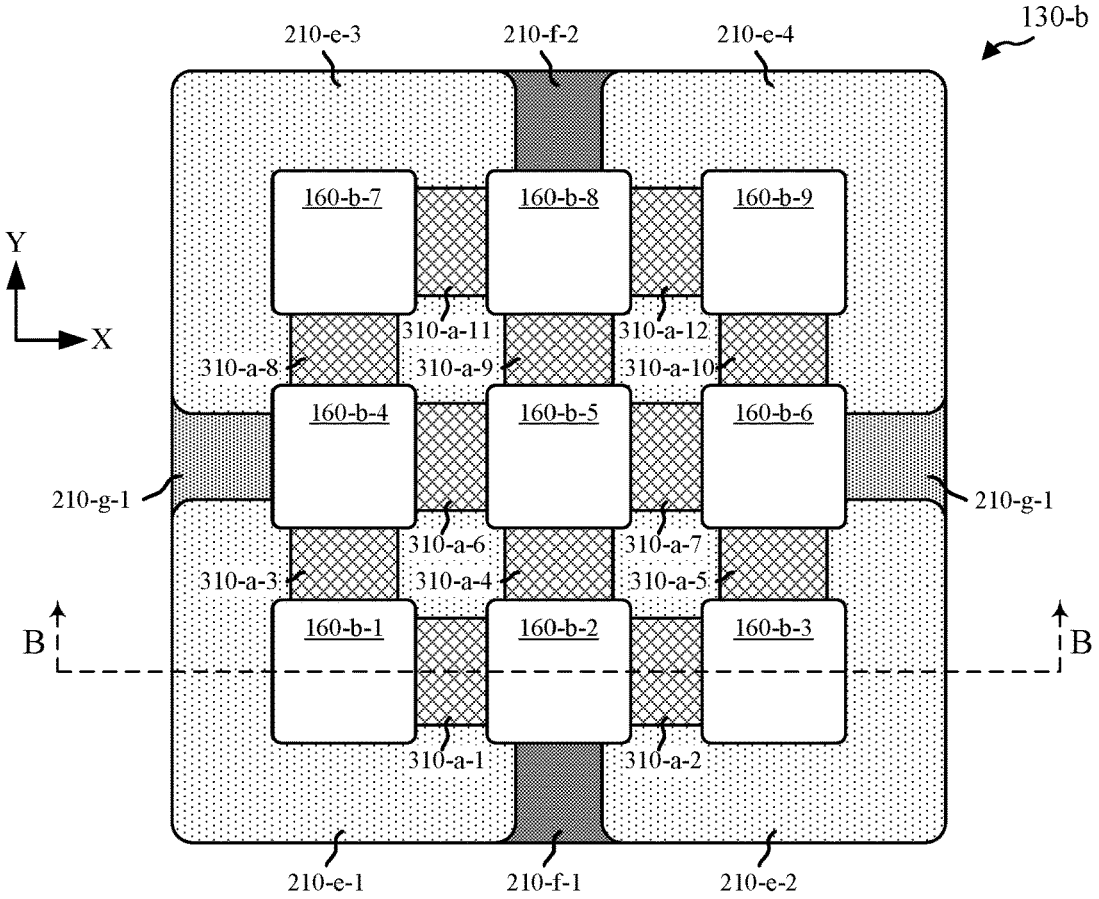
FIGS. 3A and 3B illustrate an example of an antenna array, in accordance with aspects of the present disclosure.
Figure 3B:
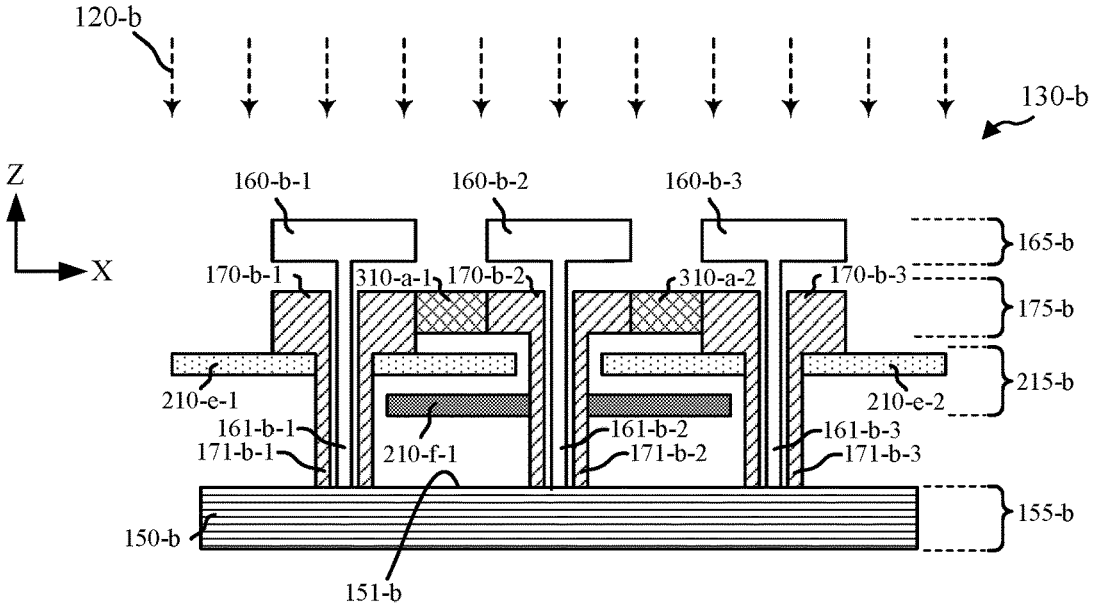

FIGS. 3A and 3B illustrate an example of an antenna array 130-*b* in accordance with aspects of the present disclosure. The antenna array 130-*b* may be another example of an antenna array 130 described with reference to FIG. 1. The antenna array 130-*b* is illustrated in a first view in FIG. 3A, which may be referred to as a "top view" showing an X-Y plane from along the Z direction, and in a second view in FIG. 3B, which may be referred to as a "side view" showing an X-Z plane from along the Y direction (e.g., a section view according to section line B-B as seen in the first view of FIG. 3A). The antenna array 130-*b* may include a substrate 150-*b* upon which a plurality of antenna elements 160-*b* and a plurality of ground elements 170-*b* are coupled.

The substrate 150-*b*, the antenna elements 160-*b*, and the ground elements 170-*b* may be examples of the corresponding components described with reference to FIG. 1. For example, the antenna array 130-*b* may be disposed in an enclosure, such as enclosure 140 described with reference to FIG. 1, where at least a portion of the antenna array 130-*b* is exposed to radiation 120-*b*. Thus, in accordance with aspects of the present disclosure, the antenna array 130-*b* may also include a plurality of shielding elements 210. The substrate 150-*b*, the antenna elements 160-*b*, the ground elements 170-*b*, and the shielding elements 210 may be similar to the corresponding components of the antenna array 130-*a* described with reference to FIG. 2.

In the example of antenna array 130-*b*, the antenna elements 160-*b*-1 through 160-*b*-9 are also arranged in a square pattern, and may be described as being components of an antenna element layer 165-*b*. Each of the antenna elements 160-*b* may be electrically coupled with the substrate 150-*b* via a respective antenna feed 161-*b*, where in the example of antenna array 130-*b*, each of the antenna elements 160-*b* are conductively coupled with its corresponding antenna feed 161-*b*. For example, an antenna element 160-*b* and a corresponding antenna feed 161-*b* may be formed from a continuous conductive material or formed from separate materials having an interface that otherwise supports the conduction of electrons (e.g., a soldered interface, a brazed interface, a welded interface).

Each of the antenna elements 160-*b* may be associated with a corresponding ground element 170-*b*, where ground elements 170-*b*-4 through 170-*b*-9 are not labeled but are associated with antenna elements 160-*b*-4 through 160-*b*-9, respectively. The set of ground elements 170-*b*-1 through 170-*b*-9 may be described as being components of an antenna ground layer 175-*b*. In the example of antenna array 130-*b*, a projected area of an antenna element 160-*b* along the Z-direction on the surface of a corresponding ground element 170-*b* is coincident with the outer perimeter of the corresponding ground element 170-*b*. Each of the ground elements 170-*b* may be electrically coupled with the substrate 150-*b* via a respective ground feed 171-*b*.

In the example of antenna array 130-*b*, different ground elements 170-*b* may have a different thickness (e.g., in the Z-direction). As illustrated, a thickness of the ground element 170-*b*-1 may be greater than a thickness of the ground element 170-*b*-2, which may be considered when selecting locations or properties of shielding elements 210. For example, an area of the substrate 150-*b* beneath the ground element 170-*b*-1 may be more shielded from radiation than an area of the substrate 150-*b* beneath the ground element 170-*b*-2 (e.g., due to the difference in thickness between ground elements 170-*b*-1 and 170-*b*-2), and thus may require less shielding from shielding elements 210.

In the example of antenna array 130-*b*, certain adjacent ground elements 170-*b* may be coupled via ground element couplings 310. For example, ground elements 170-*b*-1 and 170-*b*-2 may be coupled via ground element coupling 310-*a*-1, ground elements 170-*b*-2 and 170-*b*-3 may be coupled via ground element coupling 310-*a*-2, ground elements 170-*b*-1 and 170-*b*-4 may be coupled via ground element coupling 310-*a*-3, and so on. Although in the example of antenna array 130-*b* ground element couplings 310-*a* are only illustrated between adjacent ground elements 170-*b* of a shared row or a shared column, other antenna arrays 130 may include other configurations of ground element couplings 310. For example, a ground element coupling 310 may be included between diagonally adjacent ground elements 170, such as ground elements 170-*b*-1 and 170-*b*-5. Other configurations of ground element couplings 310 may be considered in accordance with the present disclosure for different patterns and locations of ground elements 170 in an antenna array 130.

In some examples, elements of the antenna ground layer 175-*a* (e.g., one or more ground elements 170-*b* or ground element couplings 310-*a*) may include portions that are formed from a sheet of material (e.g., a sheet of copper), where regions of the sheet of material are removed (e.g., etched, stamped, laser cut) such that the remaining portions of the sheet of material form at least the set of ground elements 170-*a* or the ground element couplings 310, or both. For example, ground element couplings 310-*a* may include a material portion (e.g., a remaining portion of the sheet of material) and a gap portion (e.g., a portion of the sheet of material removed by etching, stamping, laser cutting, or other process). Additionally or alternatively, ground element couplings 310-*a* may include a portion of the sheet of material having a thickness that is less than a thickness of the sheet of material remaining for coupled ground elements 170-*a*.

Although described in the context of a sheet of material for illustrative purposes, components of the antenna ground layer 175-*b* (e.g., ground elements 170-*b* or ground element couplings 310-*a*, or both) may be formed by other processes, such as 3-dimensional printing or other additive manufacturing, or various combinations of additive and subtractive manufacturing. In some examples, the ground elements 170-*b* and the ground element couplings 310-*a* may collectively be referred to as a ground plane of the antenna array 130-*b*. In some examples, such as when ground elements 170-*b* and ground element couplings 310-*a* are formed from a same base material (e.g., monolithically), separate reference to ground elements 170 and ground element couplings 310 may be used for illustrative purposes only and may refer to illustrative regions of an otherwise continuous component.

In the example of antenna array 130-*b*, the ground element couplings 310-*a* may support electrical continuity between ground elements 170-*b* within the antenna ground layer 175-*b*, rather than relying on electrical connections between ground elements 170-*b* via corresponding ground feeds 171-*b* and the substrate 150-*b*. In some examples, the ground element couplings 310-*a* may also have a compliance that is greater than the coupled ground elements 170-*b*, which may provide a stress relief functionality (e.g., between coupled ground elements 170-*b*). Such a stress relief functionality may mitigate the buildup of stresses, such as those described above, by providing relatively flexible movement between the coupled ground elements 170-*b*.

In the example of antenna array 130-*b*, some of the radiation 120-*b* may pass through gaps 180 between antenna elements 160-*b*, or gaps 180 between ground elements 170-*b*, or gaps 180 through ground element couplings 310-*a*, or through relatively thin portions of ground element couplings 310-*a*, or various combinations thereof, which may leave certain areas of the surface 151-*b* more vulnerable to radiation. In accordance with aspects of the present disclosure, shielding elements 210 may be included in the antenna array 130-*b* to shield those portions of the substrate 150-*b*, or other components of the antenna array 130-*b*, that are more vulnerable to radiation.

The example of antenna array 130-*b* may include a first set of shielding elements 210-*e* associated with alternating ground elements 170-*b* (e.g., alternating antenna units) of a described row or column. For example, a shielding element 210-*e*-1 may be associated with the ground element 170-*b*-1, and a shielding element 210-*e*-2 may be associated with the ground element 170-*b*-3. Each of the shielding elements 210-*a* may provide radiation shielding for gaps 180 between the respective associated ground element 170-*a* and the adjacent ground elements 170-*a* (e.g., the ground elements 170-*a* of adjacent antenna units), or for gaps 180 through ground element couplings 310-*a* associated with the respective ground element 170-*a*, or for relatively thin portions of ground element couplings 310-*a* associated with the respective ground element. For example, the shielding element

210-*a*-1 may provide radiation shielding for the gaps 180 between the ground element 170-*a*-1 and ground elements 170-*a*-2, 170-*a*-4, and 170-*a*-5, as well as radiation shielding for gaps 180 through ground element couplings 310-*a*-1 and 310-*a*-3 or relatively thin portions of ground element couplings 310-*a*-1 and 310-*a*-3.

To provide radiation shielding, a portion of the radiation 120-*b* that passes through gaps 180 or relatively thin portions of the antenna array 130-*b* (e.g., of the antenna element layer 165-*b* or the antenna ground layer 175-*b*) may be incident on one or more shielding elements 210. To provide protection from a relatively distant radiation source aligned along the Z-direction, for example, a projected area 185 of the particular gap 180 or a projected area of a relatively thin portion (e.g., of a ground element coupling 310) in the Z-direction may be incident on at least one of the shielding elements 210 prior to incidence on the substrate 150.

While a simple projection of areas in the Z-direction may provide a minimum threshold amount of radiation shielding for the antenna array 130-*b*, projected areas for defining sizes for shielding elements 210 may be expanded in various ways to accommodate the different directions of incident radiation. For example, to determine the extents of a shielding element 210 required to provide radiation shielding for a particular gap 180 or relatively thin portion (e.g., of a ground element coupling 310), a projected area may be scaled based on a distance between a gap 180 or relatively thin portion and the shielding element 210. In some examples, such scaling may be based on the angles of incidence for anticipated radiation 120, which may consider possible directions of radiation sources, possible directions of radiation 120 that may not be otherwise blocked by an enclosure 140, and other considerations. In some examples, to determine the extents of a shielding element 210 required to provide radiation shielding for a particular gap 180 or relatively thin portion, a periphery of a projected area may be expanded outward by a particular distance. Further, in some examples, a projected area of a relatively thin portion (e.g., of a ground element coupling 310) may be scaled with a relatively lower significance in comparison with a projected area of a gap 180 (e.g., where a projected area of a relatively thin portion may indicate a relatively less vulnerable area than a projected area 185 of a gap 180), because even a relatively thin portion may provide some degree of radiation shielding. Other methods for determining appropriate size and location of shielding elements 210 may be considered.

Figure 4A:
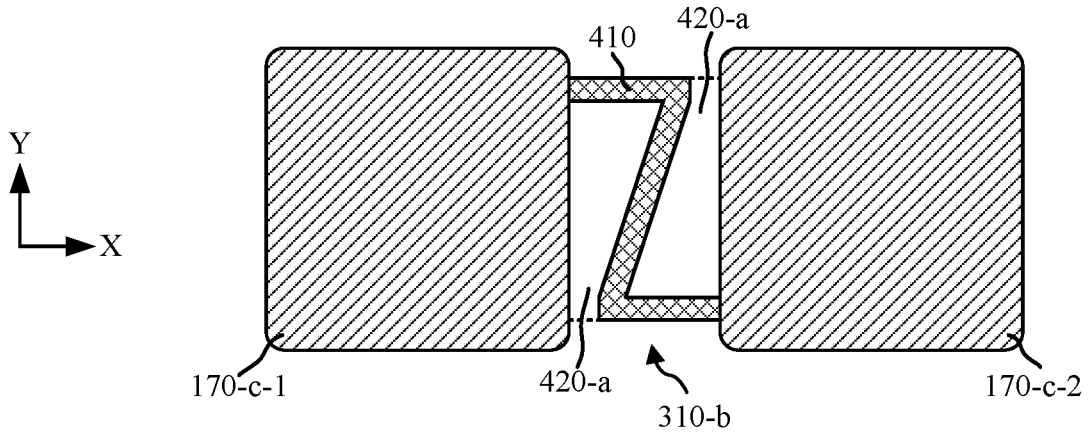
FIGS. 4A and 4B illustrate examples of ground element couplings, in accordance with aspects of the present disclosure.

FIG. 4A illustrates an example of a ground element coupling 310-*b* in accordance with aspects of the present disclosure. The ground element coupling 310-*b* may be an example of ground element couplings 310-*a* of the antenna array 130-*b* described with reference to FIG. 3. For example, ground element coupling 310-*b* may couple adjacent ground elements 170-*c*-1 and 170-*c*-2. The ground element coupling 310-*b* is illustrated in a view that may be referred to as a "top view" showing an X-Y plane from along the Z direction.

As shown in FIG. 4A, the ground element coupling 310-*b* may include a material portion 410 and two gap portions 420-*a* and 420-*b* (e.g., gaps in the material of the ground element coupling 310-*b*, gaps through the ground element coupling 310-*b* in a Z-direction). The material portion 410 may support an electrical coupling between the ground elements 170-*c*-1 and 170-*c*-2. Further, the lack of material in the gap portions 420-*a* and 420-*b* may support the ground element coupling 310-*b* having a compliance that is greater than the ground elements 170-*c*-1 and 170-*c*-2. In other words, by having gap portions 420-*a* and 420-*b*, the ground element coupling 310-*b* may support relatively free movement of the ground element 170-*c*-1 with respect to the ground element 170-*c*-2 (e.g., as compared with the relatively constrained condition that would exist with a ground element coupling 310 that did not have such gaps). Although shown as having an illustrative boundary that encloses gap portions 420-*a* and 420-*b*, in some examples the term "ground element coupling" may also refer to the material portion 410 (e.g., excluding gap portions 420-*a* and 420-*b*).

In accordance with aspects of the present disclosure, the ground element coupling 310-*b* may support a stress relief functionality between the ground elements 170-*c*-1 and 170-*c*-2. In some antenna arrays 130, such a stress relief features may facilitate the use of a material in an antenna ground layer 175 that has a different coefficient of thermal expansion than a substrate layer 155. In some examples, the use of a ground element coupling such as the ground element coupling 310-*b*, or other configurations of a ground plane that include gap portions 420, may cause portions of an antenna array 130 (e.g., a substrate 150) to be more vulnerable to radiation 120.

In accordance with aspects of the present disclosure, shielding elements 210 may be disposed between such gap portions 420 and vulnerable portions of the antenna array 130 to provide a degree of radiation shielding. In some examples the gap portions 420-*a* and 420-*b* may be considered to be examples of gaps 180, and may be associated with areas (e.g., areas 185) that may be projected to determine the positioning of shielding elements 210 to provide adequate radiation shielding.

Figure 4B:
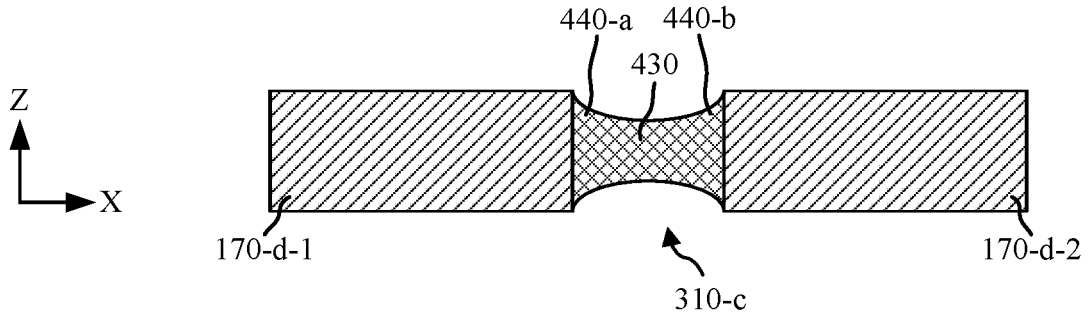

FIG. 4B illustrates an example of a ground element coupling 310-*c* in accordance with aspects of the present disclosure. The ground element coupling 310-*c* may be an example of ground element couplings 310-*a* of the antenna array 130-*b* described with reference to FIG. 3, or an example of the ground element coupling 310-*b* described with reference to FIG. 4A. For example, ground element coupling 310-*c* may couple adjacent ground elements 170-*d*-1 and 170-*d*-2. The ground element coupling 310-*c* is illustrated in a view that may be referred to as a "side view" showing an X-Z plane from along the Y direction.

As shown in FIG. 4B, the ground element coupling 310-*c* may include a relatively thin material portion 430 and relatively thick material portions 440-*a* and 440-*b* (e.g., regions adjacent to the ground elements 170-*d*-1 and 170-*d*-2). The material portions 430 and 440 may support an electrical coupling between the ground elements 170-*d*-1 and 170-*d*-2. Further, the relatively thin material portion 430 may support the ground element coupling 310-*c* having a compliance that is greater than the ground elements 170-*d*-1 and 170-*d*-2. In other words, by having a relatively thin material portion 430, the ground element coupling 310-*c* may support relatively free movement of the ground element 170-*d*-1 with respect to the ground element 170-*d*-2 (e.g., as compared with the relatively constrained condition that would exist with a ground element coupling 310 that did not have such a relatively thin material portion).

In accordance with aspects of the present disclosure, the ground element coupling 310-*c* may support a stress relief functionality between the ground elements 170-*d*-1 and 170-*d*-2. In some antenna arrays 130, such a stress relief features may facilitate the use of a material in an antenna ground layer 175 that has a different coefficient of thermal expansion than a substrate layer 155. In some examples, the use of a ground element coupling 310 such as the ground element coupling 310-*b*, or other configurations of a ground plane that include relatively thin material portions, may cause portions of an antenna array 130 (e.g., a substrate 150) to be more vulnerable to radiation 120. In accordance with aspects of the present disclosure, shielding elements 210 may be disposed between such relatively thin material portions 430 and vulnerable portions of the antenna array 130 to provide a degree of radiation shielding.

The detailed description set forth above in connection with the appended drawings describes examples and does not represent the only examples that may be implemented or that are within the scope of the claims. The term "example," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and apparatuses are shown in block diagram form in order to avoid obscuring the concepts of the described examples.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

As used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed herein.

What is claimed is:

1. An antenna array comprising:

a substrate;

a plurality of antenna units, each of the plurality of antenna units comprising:

an antenna element electrically coupled with a surface of the substrate; and a ground element electrically coupled with the surface of the substrate, the ground element disposed at least in part between the antenna element and the surface of the substrate; and a plurality of shielding elements disposed between the surface of the substrate and the ground elements of the plurality of antenna units, each of the plurality of shielding elements directly coupled with no more than one of the plurality of antenna units, wherein, for each of a plurality of gaps between ground elements of adjacent antenna units, a projected area of a respective gap in a direction perpendicular to the surface of the substrate is incident on at least one of the plurality of shielding elements.

2. The antenna array of claim 1, wherein, for at least one of the plurality of shielding elements, a respective shielding element is coupled with a single one of the plurality of antenna units at a location between the ground element of the single one of the plurality of antenna units and the surface of the substrate.

3. The antenna array of claim 1, further comprising:

a plurality of ground element couplings, each of the plurality of ground element couplings coupling ground elements of adjacent antenna units, and each of the plurality of ground element couplings having a compliance that is greater than a compliance of the coupled ground elements of the adjacent antenna units.

4. The antenna array of claim 3, wherein, for at least one of the plurality of ground element couplings, a respective ground element coupling comprises a conductive material portion and a gap in the conductive material portion through the respective ground element coupling along the direction perpendicular to the surface of the substrate, wherein the plurality of gaps between ground elements of adjacent antenna units comprises the gap in the conductive material portion through the at least one of the plurality of ground element couplings.

5. The antenna array of claim 3, wherein, for at least one of the plurality of ground element couplings, a respective ground element coupling comprises a conductive material portion having a thickness that is less than a thickness of the ground elements of the adjacent antenna units that are coupled by the respective ground element coupling.

6. The antenna array of claim 1, wherein, for at least one of the plurality of antenna units, a projection of an area of the antenna element of a respective antenna unit along the direction perpendicular to the surface of the substrate overlaps an area of the ground element of the respective antenna unit.

7. The antenna array of claim 1, wherein, for at least one of the plurality of antenna units, the antenna element of a respective antenna unit is electrically coupled with the surface of the substrate via a conductive antenna feed of the respective antenna unit, the conductive antenna feed of the respective antenna unit passing through at least one of the ground element of the respective antenna unit or one of the plurality of shielding elements.

8. The antenna array of claim 7, wherein, for the at least one of the plurality of antenna units, the conductive antenna feed of a respective antenna unit is capacitively coupled with the antenna element of the respective antenna unit.

9. The antenna array of claim 7, wherein, for the at least one of the plurality of antenna units, the conductive antenna feed of a respective antenna unit is conductively coupled with the antenna element of the respective antenna unit.

10. The antenna array of claim 1, wherein a material of at least one of the plurality of shielding elements is the same as a material of at least one ground element of the plurality of antenna units.

11. The antenna array of claim 1, wherein a material of at least one of the plurality of shielding elements is different from a material of at least one ground element of the plurality of antenna units.

12. The antenna array of claim 1, wherein the substrate comprises a printed circuit board.

13. The antenna array of claim 1, wherein the substrate comprises a semiconductor chip.

14. The antenna array of claim 1, wherein, for at least one of the plurality of shielding elements, a respective shielding element is directly coupled with a single one of the plurality of antenna units, and the respective shielding element is indirectly coupled with at least one of the plurality of antenna units that is different from the single one of the plurality of antenna units.

15. An antenna array comprising:

a substrate;

an antenna element layer comprising a plurality of antenna elements, each of the plurality of antenna elements electrically coupled with the substrate;

an antenna ground layer disposed between the antenna element layer and the substrate, the antenna ground layer comprising a plurality of ground elements each corresponding to a respective one of the plurality of antenna elements, wherein each of the plurality of ground elements is electrically coupled with the substrate; and a shielding layer disposed between the antenna ground layer and the substrate, the shielding layer comprising a plurality of shielding elements between the antenna ground layer and the substrate, wherein each of the plurality of shielding elements is directly coupled with a ground element, a ground feed, or both, as associated with no more than one of the plurality of ground elements, and wherein, for each of a plurality of gaps of the antenna ground layer, a projected area of a respective gap in a direction perpendicular to the substrate is incident on at least one of the plurality of shielding elements.

16. The antenna array of claim 15, wherein each of the plurality of ground elements is electrically coupled with at least one other of the plurality of ground elements via a conductive ground element coupling that is more compliant than the electrically coupled ground elements.

17. The antenna array of claim 16, wherein, for at least one of the ground element couplings, a respective ground element coupling comprises a gap in a material portion of the antenna ground layer through the respective ground element coupling along the direction perpendicular to the substrate, wherein the plurality of gaps of the antenna ground layer comprises the gap in the material portion of the antenna ground layer of the for the at least one of the ground element couplings.

18. The antenna array of claim 16, wherein, for at least one of ground element couplings, a respective ground element coupling comprises a material portion of the antenna ground layer having a thickness that is less than a thickness of the ground elements of the antenna ground layer that are electrically coupled by the respective ground element coupling.

19. The antenna array of claim 16, wherein the plurality of ground elements and the ground element couplings comprise a contiguous material portion of the antenna ground layer.

20. The antenna array claim 15, wherein, for at least one of the plurality of antenna elements, a projection of an area of the respective antenna element along the direction perpendicular to the substrate overlaps an area of the corresponding ground element of the antenna ground layer.

21. The antenna array of claim 15, wherein, for at least one of the plurality of antenna elements, the respective antenna element is electrically coupled with the substrate via a conductive antenna feed, the conductive antenna feed passing through the antenna ground layer and the shielding layer.

22. The antenna array of claim 21, wherein, for the at least one of the plurality of antenna elements, the conductive antenna feed for the respective antenna element is capacitively coupled with the respective antenna element.

23. The antenna array of claim 21, wherein, for the at least one of the plurality of antenna elements, the conductive antenna feed for the respective antenna element is conductively coupled with the respective antenna element.

24. The antenna array of claim 15, wherein a material of at least one of the plurality of shielding elements is the same as a material of the antenna ground layer.

25. The antenna array of claim 15, wherein a material of at least one of the plurality of shielding elements is different from a material of the antenna ground layer.

26. The antenna array of claim 15, wherein, for at least one of the plurality of shielding elements, a respective shielding element is directly coupled with a ground element, a ground feed, or both, as associated with a single one of the plurality of ground elements, and the respective shielding element is indirectly coupled with a ground element, a ground feed, or both, as associated with at least one of the plurality of ground elements that is different from the single one of the plurality of ground elements.

* * * * *